United States Patent [19]

Rollins et al.

[11] 3,952,634

[45] Apr. 27, 1976

[54] CARTON BLANK FORMING APPARATUS

[75] Inventors: Paul Ferdinand Rollins, Stevenage; Christopher John Chamberlain, St. Neots, both of England

[73] Assignee: Bowater Packaging Limited, London, England

[22] Filed: Sept. 9, 1974

[21] Appl. No.: 503,941

[52] U.S. Cl. ..... 93/49 R; 93/51 R

[51] Int. Cl.[2] ..... B31B 3/26

[58] Field of Search..... 93/51 HW, 51 R, 51 M, 93/49 R, 47, 45, 36 R, 59 R, 53 CE; 53/186

[56] References Cited

UNITED STATES PATENTS

| | | | |
|---|---|---|---|
| 2,189,105 | 2/1940 | Evans et al. | 93/51 R |
| 2,848,926 | 8/1958 | Gschwind et al. | 93/51 HW |
| 3,359,873 | 12/1967 | Carle et al. | 93/37 SP |
| 3,416,653 | 12/1968 | Farquhar | 93/37 SP |
| 3,792,646 | 2/1974 | Bauer | 93/51 R |

*Primary Examiner*—James F. Coan

*Attorney, Agent, or Firm*—Baldwin, Wight & Brown

[57] ABSTRACT

A machine for forming from a one-piece flat carton blank a carton suitable for packaging biscuits and the like, which carton can be folded between transit and display positions and which is normally shrink-wrapped for transit purposes, which shrink-wrapping can be removed to allow the carton to be folded into its display position for use in supermarkets, the machine including a frame, support means for supporting the blank at a first folding station and folding means at said station for partially forming the blank into a carton and transferring it to a second folding station at which second folding means complete the erection of the carton, the first folding operation causing carton divider panels to be folded into back to back relationship and the second folding operation folding up side, end and glue flaps so that the carton is in a display position ready for filling, whereupon it can subsequently be folded to a transit position ready for shrink-wrapping.

14 Claims, 5 Drawing Figures

67
61
69
15
27
17
67
25
17
15
31
51
35
29
73
45
45
75
F
13
41
T
71
33
D
S
B
E
9
33
15

CARTON BLANK FORMING APPARATUS

This invention relates to apparatus for forming a carton blank into a carton which is especially suitable for packaging biscuits and the like and which can eventually be used for display purposes in supermarkets and stores.

Biscuits are nowdays sold in cylindrical packets and the packets are transported from the manufacture to supermarkets in containers made of fibrous sheet material. It is now proposed that instead of using a container made wholly of fibrous sheet material, a tray of fibrous sheet material be used, in which the packets of biscuits are packed and which is then wrapped in a transparent plastics material, for example, by means of shrink wrapping apparatus. The tray can be delivered to the supermarket in its shrink wrapped condition, the shrink wrapping can then be removed, the tray can then be "folded" to an alternative position so that it is suitable for storing on a shelf with the packets of biscuits on display. The apparatus of the present invention is designed to form such a tray from a carton blank so that the tray is ready for filling with packets of biscuits.

The apparatus of the present invention is specifically designed to provide a tray of container from a blank which comprises a pair of rectangular equal-sized divider panels foldably connected along a side edge, a pair of base panels each foldably connected to a divider panel along a side edge parallel to said first mentioned side edge, a plurality of side flaps foldably connected respectively to end edges of the divider and base panels, an end flap foldably connected to an outer edge of each base panel and glue flaps foldably connected to each end flap, the blank being foldable so that the divider flaps are arranged in back-to-back relationship with the base flaps extending normally to the divider flaps and with the side flaps upstanding relative to their respective divider and base flaps and with the end flaps upstanding relative to the base flaps and connected to their adjacent side flaps by the glue flaps and being further foldable for transport purposes, preferably after filling, so that the divider flaps provide temporary base panels. Such a blank will hereinafter be referred to as a blank of the type described.

According to the present invention, we provide blank folding apparatus for folding a blank of the type described into a carton comprising means for supporting a blank at a first folding station, folding means for folding the blank at the first folding station from a lay-flat condition into a condition with its divider panels in back-to-back relationship and upstanding relative to the base panels with the side flaps connected to the divider panels upstanding relative to the divider panels, means for supporting the partially folded blank at a second folding station, folding means associated with the second folding station to fold the side and end flaps connected to the base panels upwardly relative to the base panels and to fold in the glue flaps to lie against said side flaps, whereupon the carton may then be removed from the second folding station.

Preferably, the apparatus includes a feed mechanism to feed blanks from a store to the first folding station, means for applying adhesive to selected areas of the blank as it is fed to the first folding station, and a transfer device to remove the erected carton from the second folding station.

In a particular arrangement, the blank support means at the first folding station comprises a pair of oppositely disposed plates spaced apart a distance slightly greater than the width of the divider panels and on which the side flaps foldably connected to the divider panels rest, and ledges on which the end flaps rest.

Preferably, a first folding device is provided at the first folding station and is arranged to push the blank past the plates towards the second folding station and at the same time to fold the divider panels into back-to-back relationship and the side flaps connected to them into their upstanding positions.

In a preferred arrangement, the first folding device includes two generally L-shaped folding members each of which is pivotally connected adjacent the end of one of the arms of the L to a sub-frame supported on the main frame and a reciprocatable cross-member vertically slidable relative to the sub-frame under the action of a ram, the cross-member being pivotally connected to each L-shaped folding member by a link so that, upon sliding movement of the cross-member, relative to the sub-frame, each L-shaped folding member will be rocked through 90°, thereby folding the divider flaps into back-to-back relationship from their lay-flat condition. Preferably, each L-shaped folding member is comprised of a pair of plates, one of which is slightly smaller than its respective divider panel and the other of which is slightly smaller than the base panel connected to said divider panel so that, during the first folding operation, the one arm as it pivots through 90° will engage the divider flap and the other arm will then move into engagement with the base panel connected to the divider panel to push the partially erected blank through the first folding station to the second folding station.

Perferably, the support plates have smoothed edges to fold in the side flaps connected to the divider panels as the blank is pushed off the plates by the first folding means and advanced from the first to the second folding station.

Perferably, the folding means at the second folding station is separate from that at the first station and similar to that disclosed in the complete specifications of our U.S. Pat. Nos. 1,285,801 and 1,192,392 and is comprised generally of a plurality of inclined cam surfaces past which the partially folded blank is advanced in known manner.

Perferably, the folding means at the second folding station includes a plunger formed by the first folding device, which is movable bodily relative to the main frame by means of a ram to move the partially erected carton past the cam surfaces to the second folding station and fold the remaining side flaps and end flaps and the glue flaps to their upstanding positions.

Perferably, two gates are associated with the transfer device, which is located beneath the second folding station, and are moved to an open position to allow passage of the folded carton from the apparatus upon operation of the transfer device.

Perferably, means are provided beneath the second folding station to maintain the carton in its folded position with the divider panels in back-to-back relationship prior to operation of the transfer device. These means may comprise bar-like members engageable with the top edges of the side flaps upstanding from the base panels.

At a station remote from the second folding station, means may be provided automatically to fill the carton with packets of biscuits and further means may then be provided to fold the carton from a display position into a transit position so that its divider panels form temporary base panels whereupon the carton may then be transferred to a shrink wrapping machine.

A preferred embodiment of the carton blank folding apparatus in accordance with the present invention is now described with reference to the accompanying, partly schematic drawings, in which.

Figure 3:
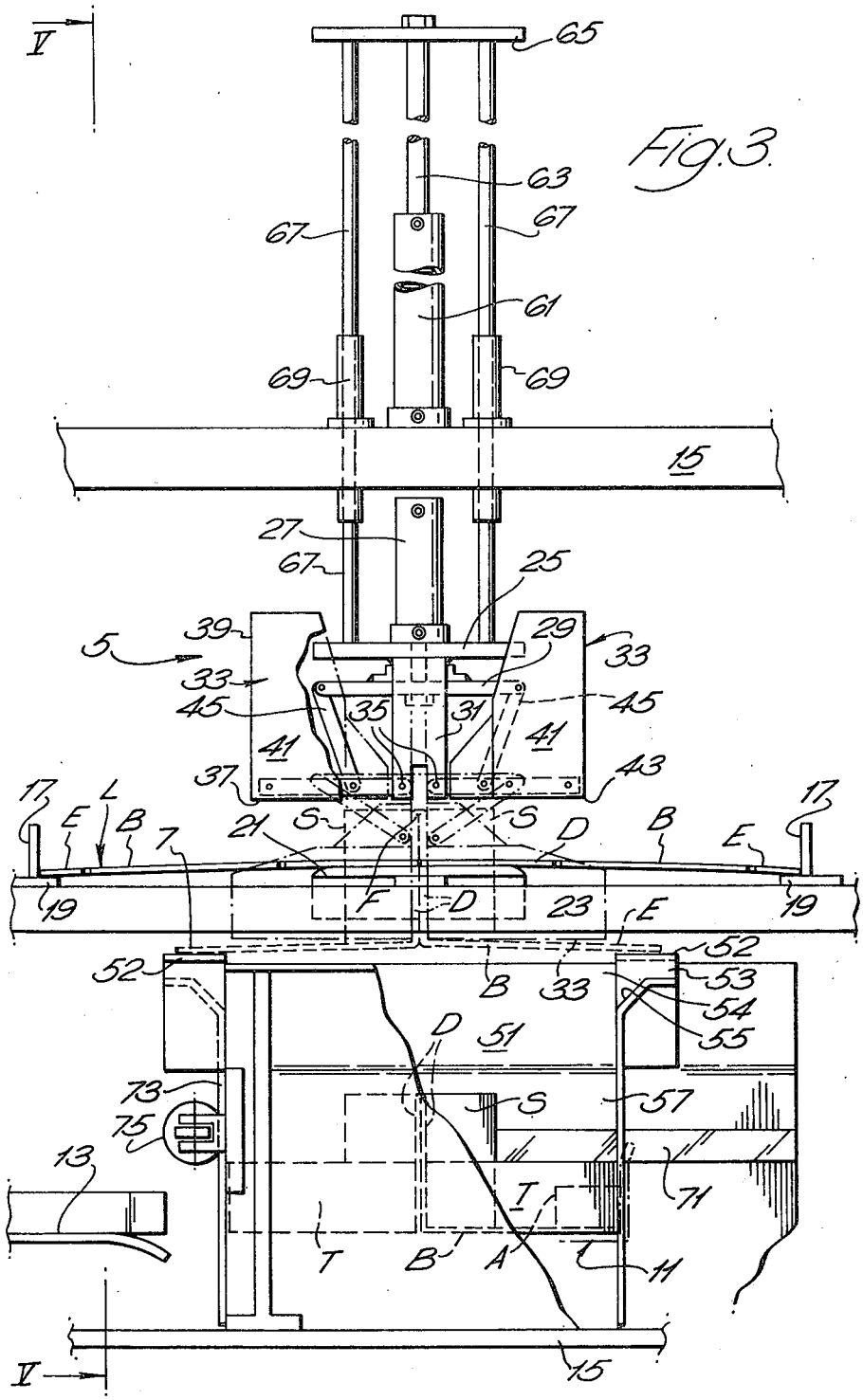
FIG. 3 is an elevation of part of the apparatus showing a first folding device and blank ready for folding at a first folding station (in full lines) and the blank and first folding device after a folding operation has been completed (in broken lines)
Figure 4:
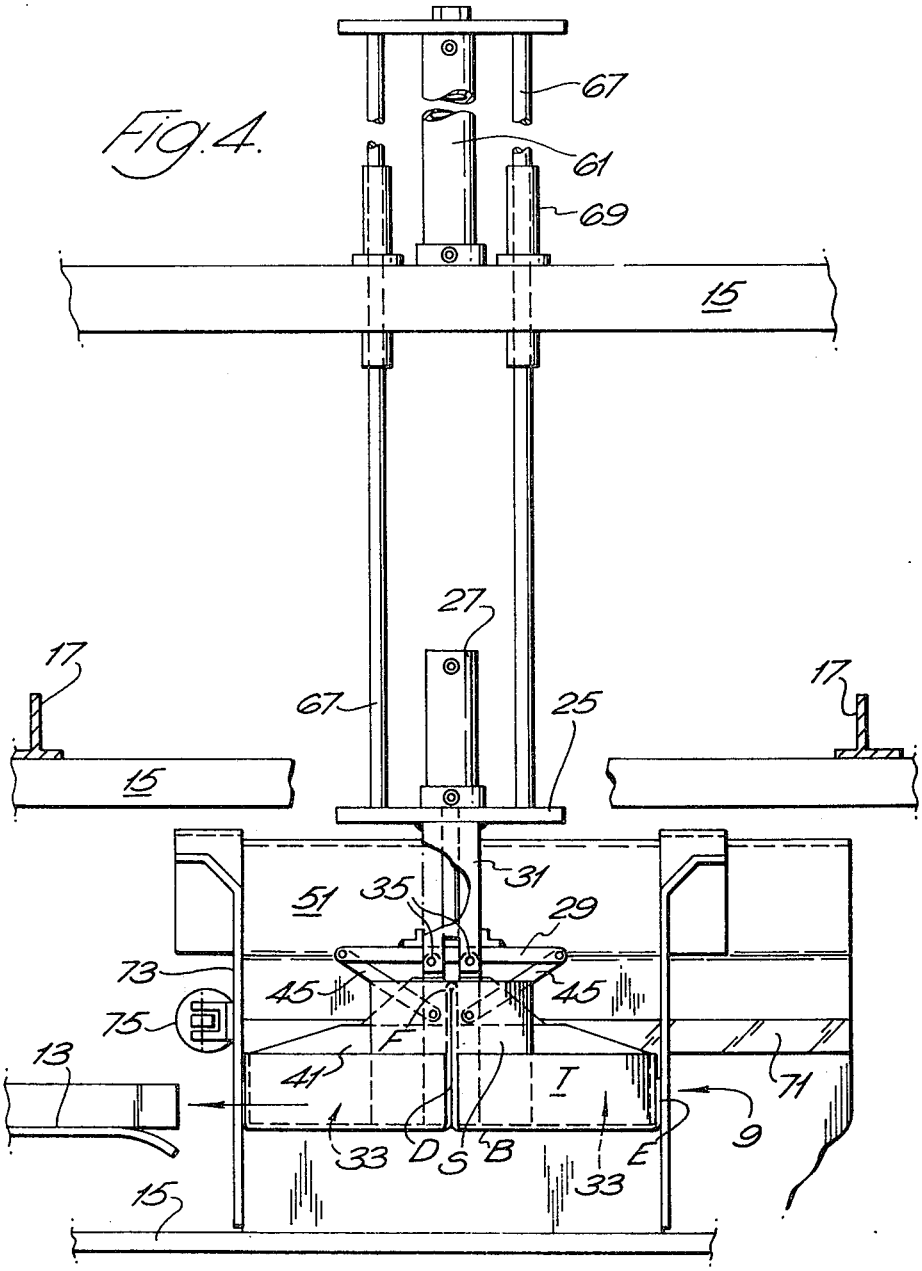
Figure 5:
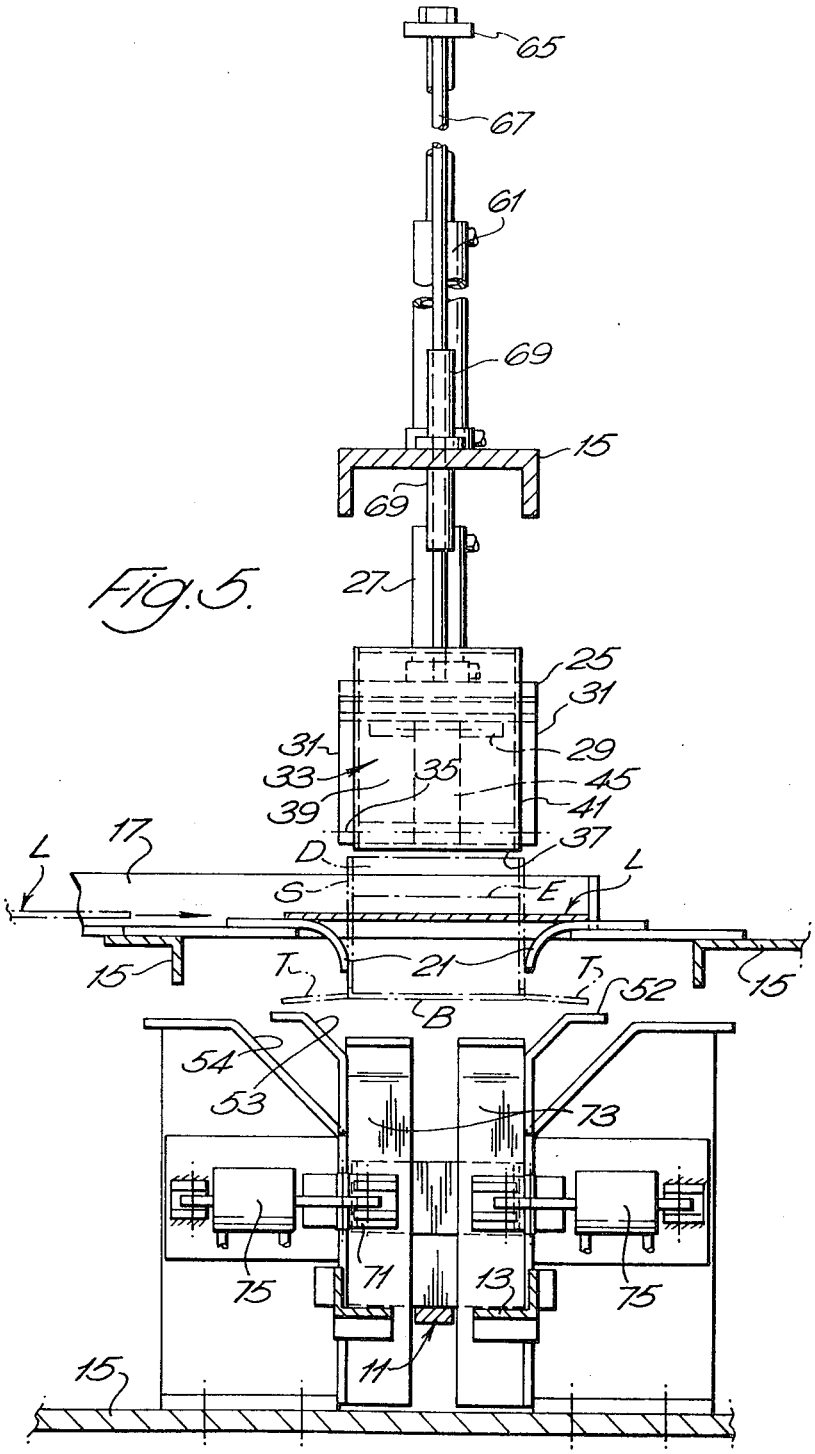

FIG. 4 is a view similar to FIG. 3 but illustrating a second folding operation, and FIG. 5 is a sectional, elevation on the line V—V of FIG. 3. Referring to the drawings, the carton blank L includes a pair of identical rectangular divider panels D foldably connected to each other along a fold line F. Side flaps S are foldably connected to each side edge of each divider panel D along parallel fold lines G. To the end of each divider panel D, a base panel B is foldably connected about a fold line H parallel to the fold line F. Further side flaps T are foldably connected to each side of each base panel B about fold lines J parallel to the fold lines G. An end flap E is foldably connected to each base panel B along its end edge remote from and parallel to the fold lines H and a glue flap A is foldably connected to the side edge of each end flap E about a fold line K colinear with the fold lines G.

Figure 1:
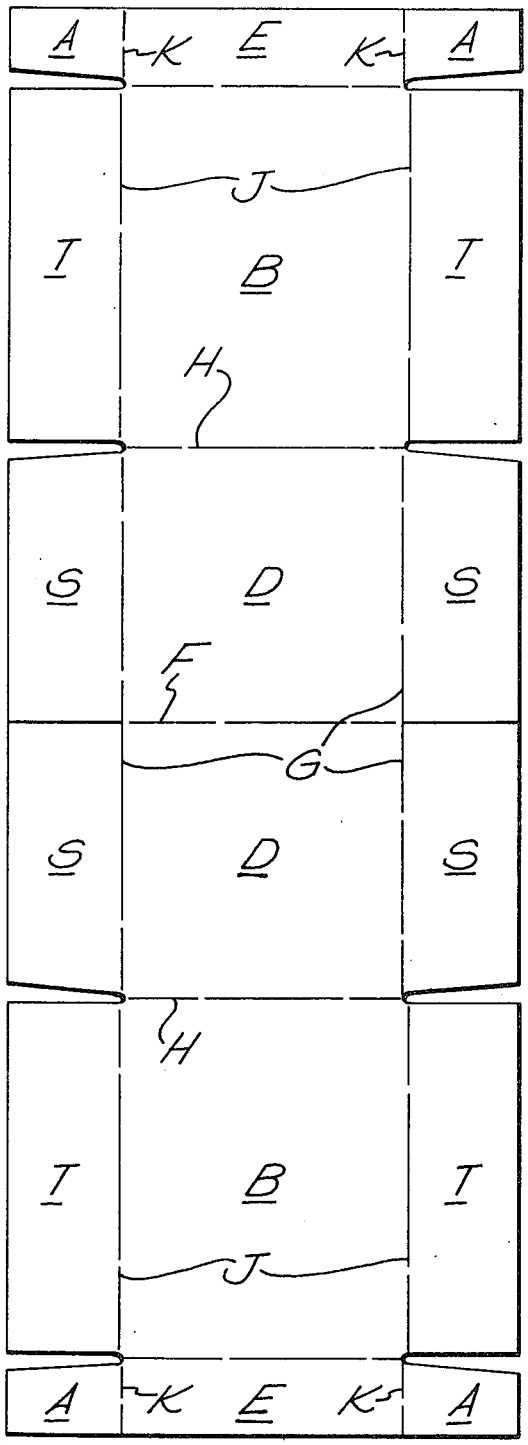
FIG. 1 is a plan view of the blank which the apparatus is designed to fold into a carton.
Figure 2:
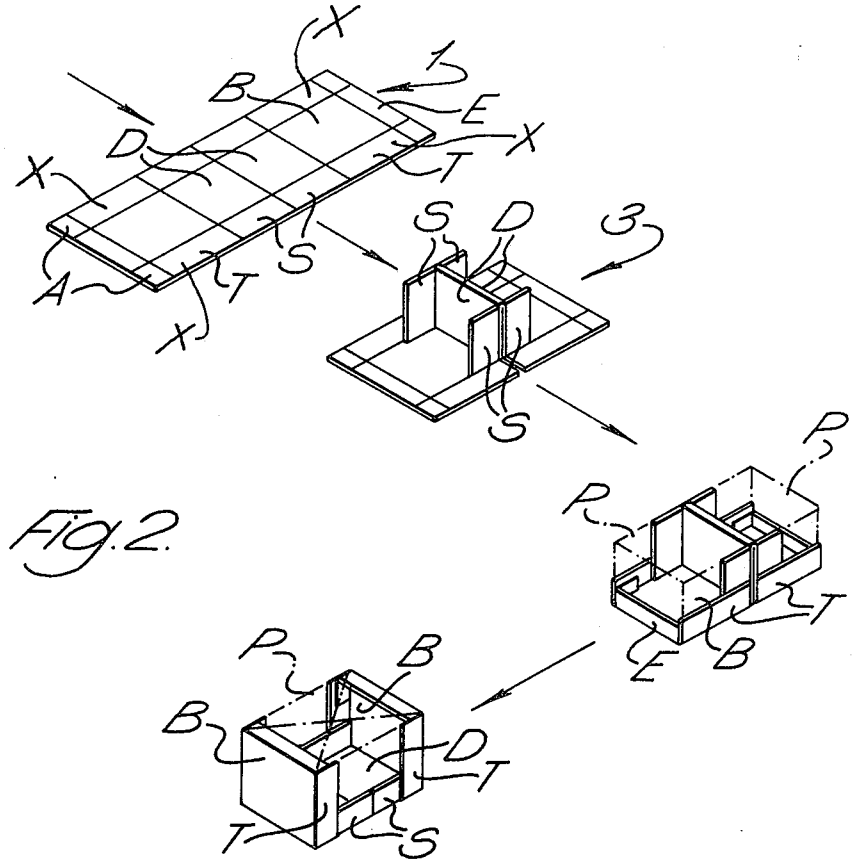
FIG. 2 is a flow diagram showing respectively the blank of FIG. 1, the blank after it has been partially folded at a first folding station of the apparatus, the blank after it has been fully folded into a carton at a second folding station of the apparatus and a carton after it has been filled and folded from its machine erected state to a state ready for shrink wrapping and storage.

As can be seen from FIG. 2, the blank L is arranged to be fed in lay-flat state into the apparatus to the position indicated generally at 1 in FIG. 2 by any known feed device (not shown) from a stack, as and when required. As each individual carton is fed into the apparatus from the stack it passes beneath a plurality of glue applicators which supply an adhesive on to the carton at the locations which are indicated at X in position 1 in FIG. 2. It will be appreciated that after the folding operation this adhesive will cause the glue flaps to adhere to the side flaps T and the side flaps S to adhere to the inner face of the side flaps T.

When the blank is in the position 1 of FIG. 2, the apparatus is operated to perform a first folding operation at a first folding station 3 to fold the blank to the second position shown in FIG. 2, wherein the divider panels D are arranged in back-to-back relationship with the side flaps S upstanding from them. By the time this first folding operation has been completed, the first folding device indicated generally at 5 in FIG. 3 will have moved from its full line position to its broken line position and the blank will have been partially folded to occupy the position shown by the dotted lines 7 in FIG. 3. Thereupon a second folding operation is performed upon the partly folded blank to erect it into the carton shown in the third position of FIG. 2 and indicated generally at 9 in FIG. 4.

Once the blank has been folded, it is transferred from the apparatus by a transfer device indicated generally at 11 on to a conveyor or the like 13 where the carton can then be filled with packets of biscuits P (FIG. 2) either by hand or mechanically. The filled carton can then be advanced, for example, at right angles to the direction of flow of the conveyor 13 whereupon it can be folded automatically to the position shown in the fourth part of FIG. 2, wherein the divider panels D provide temporary base panels and the base panels B provide temporary upstanding end walls. The carton can then pass through a shrink wrapping machine so that it is ready for storage and/or transport to a supermarket or other store.

When in the store, the shrink wrapping material around the carton can be removed, the carton can be re-folded back to the position shown in the third part of FIG. 2, which is an optimum position for displaying the contents of the carton, e.g. packets of biscuits, and if necessary the carton can be slit into two by tearing along the fold line F.

Referring to FIG. 3, the apparatus further includes a frame 15 supporting the first folding device 5 and suitable adjustable guides 17 for locating the end edges of the blank in the position 1 at the first folding station 3. The blank at the position 1 is supported on ledges 19 by means of its end flaps E and also on a pair of horizontally spaced support plates 21, the spacing between the innermost edges of which is slightly greater than the spacing between the fold lines G at either side edge of the divider panels D to allow passage of the divider panels between the support plates on operation of the first folding device 5. The side and innermost edges of the support plates 21 are of smooth rounded construction as shown at 23 to prevent tearing of the blank and to assist in folding up of the side flaps S relative to the divider panels D as will be described.

The first folding device 5 is supported from a sub-frame 25 which itself is supported on the main frame 15. Operating between the sub-frame 25 and a reciprocatable cross-member 29 is a first fluid, e.g. pneumatically operated piston and cylinder device 27, the piston being connected to the cross-member 29. Secured to the sub-frame 25 is a depending guideway 31 on which the cross-member 29 slides, and the lower end of which is bifurcated to provide two limbs to each of which a L-shaped folding member 33 is connected about a pivot 35. Each L-shaped folding member 33 is formed from a plate 37 a slightly smaller dimensions than the divider panels D, a plate 39 of slightly smaller dimensions than the base panels B and suitable side bracing plates 41 connected, e.g. by welding, to the respective plates 37 and 39. Each end of the cross-member 39 is pivotally connected to one of the L-shaped folding members 33 by connecting links 45.

When a blank is correctly located at the first folding station as shown at 1, a signal is sent to the piston and cylinder device 37 to extend its piston to operate the first folding device, whereupon the cross-member 29 will be moved downwardly from its full line position, thereby causing the members 33 to rotate about their pivots 35 towards their broken line positions. During the pivoting movement, the apexes 43 of the folding members 33 will engage the divider panels D just inwardly of the fold lines H and because of the reaction provided by the support plates 21, the innermost portions of the divider panels D will be folded upwardly about their fold line F, whereas the outermost portions will be folded downwardly and inwardly causing breaking to occur about the fold lines H so that eventually the carton will take up the partly folded position indicated by the broken lines 7. During this folding operation, the downward folding movement of the divider panels D past the plates 21 will result in the side flaps S being folded upwardly relative to the divider panels D, as the blank is pushed bodily beneath the plates 21 by continued extrusion of the piston.

Once the first folding operation has been completed, the plates 39 will bear against the base panels B and the plates 37 will bear against the divider panels D which will be in back-to-back relationship and sandwiched between the plates 37. The end flaps E and side flaps T and glue flaps A will then support the partly erected blank on ledges 52 above a second folding station 51 which is similar to that disclosed in the complete specifications of our U.S. Pat. Nos. 1,285,801 and 1,192,392. This second folding station is provided with station cam surfaces 53, 54 and 55 for completing erection of the carton as it is pushed downwardly past the cam surfaces into a passageway 57. During this movement of the carton, the glue flaps A are folded upwardly relative to the end flaps E by the cam surfaces 53 and end flaps E are folded upwardly relative to the base panels B by the cam surfaces 55 whereupon the side flaps T are folded upwardly relative to the base panels B by the cam surfaces 54, the arrangement being such that the glue flaps A will be located inside the side flaps T. This folding operation is performed by moving the first folding device 5 in its entirety vertically downwards into the passageway 57 by operation of a second fluid operated piston and cylinder device 61. The cylinder of the device 61 is connected to the frame 15 and its piston 63 is connected to a crossbar 65 from which rods 67 depend and then pass through guide sleeves 69 on the frame member 15 and are connected at their lower ends to the sub-frame 25. As the device 61 is retracted, so the rods 67 will move the sub-frame 25 downwardly to perform the second folding operation, the stroke of the device 61 being sufficient to move the carton blank past the cam surfaces 53, 54 and 55 and sufficiently far into the passageway 57 that the upper edges of the side flaps T will engage beneath the lower edge of a bar 71 extending across the passageway, to maintain the fully erected carton in that state shown by dotted lines 9 and allow the glue to set.

Finally, before a following blank can be folded into a carton it is necessary to retract the first and second folding devices and to remove the folded carton from the passageway 57 as soon as possible by means of the transfer device 11. Because it is necessary to apply pressure to the folded carton to allow the adhesive to set, the passageway must be closed on all four sides. However, since the transfer device is designed to remove the carton sideways from the passageway and on to the conveyor 13, one of the side walls of the passageway must be opened at the same time as the transfer device 11 is operated. This operation is achieved by opening a pair of hingedly mounted gates 73 with the aid of fluid operated piston and cylinder devices 75 connected between the gates and the frame 15. The transfer device 11 comprises an L-shaped bracket connected to a ram or like power device (not shown) and has a stroke sufficient to move the erected carton fully from the passageway 57 on to the conveyor 13.

In an alternative construction, it is envisaged that a single ram could be utilised to perform both folding operations, for example, by being advanced in two stages.

It will be appreciated that the apparatus is fully adjustable, and able to accommodate blanks of various sizes.

What is claimed is:

1. Blank folding apparatus for folding a blank of the type described into a carton comprising a frame, means on said frame for supporting a blank at a first folding station, folding means for folding such blank at said first folding station from a lay-flat condition into a condition with its divider panels in back-to-back relationship and upstanding relative to the base panels with the side flaps connected to the divider panels upstanding relative to the divider panels, means on said frame for supporting the partially folded blank at a second folding station, folding means associated with said second folding station to fold the side and end flaps connected to the base panels upwardly relative to the base panels and to fold in the glue flaps to lie against said side flaps, whereupon the carton may then be removed from said second folding station, said blank support means at said first folding station including a pair of oppositely disposed plates spaced apart a distance slightly greater than the width of the divider panels and on which the side flaps foldably connected to the divider panels rest, and ledges on which the end flaps rest, a first folding device at said first folding station for pushing the blank past the plates towards said second folding station and at the same time to fold the divider panels into back-to-back relationship and the side flaps connected to them into their upstanding positions, said first folding device including a sub-frame, two generally L-shaped folding members, means pivotally connecting each of said L-shaped members adjacent the end of one of the arms of the L to said sub-frame, means supporting said sub-frame on said main frame and a reciprocatable cross-member vertically slidable relative to said sub-frame under the action of a ram, a link pivotally connecting said cross-member to each L-shaped folding member so that, upon sliding movement of the cross-member, relative to the sub-frame, each L-shaped folding member will be rocked through 90°, thereby folding the divider flaps into back-to-back relationship from their lay-flat condition.

2. Blank folding apparatus as claimed in claim 1 wherein said second folding means at said second folding station includes a plurality of inclined cam surfaces past which the partially folded blank is advanced by said main ram.

3. Blank folding apparatus as claimed in claim 2 wherein said main ram is connected to a cross bar supporting rods slidable relative to said frame and connected to said sub-frame, said sub-frame and said first folding means when in their second position forming a plunger movable by said main ram bodily relative to said main frame to move a partially erected carton past said cam surfaces at said second folding station to fold the remaining side flaps and end flaps and the glue flaps to upstanding positions relative to respective ones of the base panels.

4. Blank folding apparatus as claimed in claim 1 wherein each said L-shaped folding member is comprised of a pair of plates, one of which is slightly smaller than its respective divider panel and the other of which is slightly smaller than the base panel connected to said divider panel so that, during the first folding operation, the one plate as it pivots through 90° will engage the divider panel and the other plate will then move into engagement with the base panel connected to the divider panel to push the partially erected blank through the first folding station to the second folding station.

5. Blank folding apparatus for folding a blank of the type described into a carton comprising a frame, means on said frame for supporting a blank at a first folding station, folding means for folding such blank at said first folding station from a lay-flat condition into a condition with its divider panels in back-to-back relationship and upstanding relative to the base panels with the side flaps connected to the divider panels upstanding relative to the divider panels, means on said frame for supporting the partially folded blank at a second folding station, folding means associated with said second folding station to fold the side and end flaps connected to the base panels upwardly relative to the base panels and to fold in the glue flaps to lie against said side flaps, whereupon the carton may then be removed from said second folding station, a transfer device for removing the erected carton from said second folding station, means beneath said second folding station for maintaining the carton in its folded position with the divider panels in back-to-back relationship prior to operation of said transfer device, said means beneath the second folding station including bar-like members engageable with the top edges of the side flaps upstanding from the base panels.

6. Blank folding apparatus for folding a blank of the type including centrally located adjacent divider panels, base panels adjacent said divider panels, side and end flaps, and glue flaps into a carton; said apparatus comprising a frame, first and second folding stations, first support means on said frame for supporting a flat blank at said first folding station, second support means at said second folding station for supporting a partially folded blank thereon after transfer from said first folding station, a vertically reciprocal main ram movable from a first position to a second position for folding the blank from its partially erected state into said carton, first folding means mounted on a movable part of said ram, means to move said first folding means from a first position to a second position to fold said blank at said first folding station from a lay-flat condition into said partially erected state with its divider panels in back-to-back relationship and upstanding relative to the base panels, movement of said first folding means causing said blank to move vertically relative to said first support means, said vertical movement automatically causing the side flaps on said divider panels to be folded so as to upstand relative to said divider panels, and second folding means associated with said second folding station to assist with the folding of side and end flaps connected to the base panels upwardly relative to the base panels and to fold in the glue flaps to lie against said side flaps, upon movement of the movable part of said main ram to its said second position to move the partially erected blank off said second support means and form said carton, whereupon the carton may then be removed from said second folding station.

7. Blank folding apparatus as claimed in claim 6 wherein said first folding means includes a sub-frame, two generally L-shaped folding members, means pivotally connecting each of said L-shaped members adjacent an end of one of the arms of the L to said sub-frame, means supporting said sub-frame on said movable part of said main ram and a reciprocatable cross-member vertically slidable relative to said sub-frame under the action of a further ram, a link pivotally connecting said cross-member to each L-shaped folding member so that, upon sliding movement of the cross-member, relative to the sub-frame, each L-shaped folding member will be rocked through 90°, thereby folding the divider flaps into back-to-back relationship from their lay-flat condition.

8. Blank folding apparatus as claimed in claim 7 wherein each said L-shaped folding member is comprised of a pair of plates, one of which is slightly smaller than its respective divider panel and the other of which is slightly smaller than the base panel connected to said divider panel so that, during the first folding operation, the one plate as it pivots through 90° will engage the divider panel and the other plate will then move into engagement with the base panel connected to the divider panel to push the partially erected blank through the first folding station to the second folding station.

9. Blank folding apparatus as claimed in claim 6 wherein said first support means at said first folding station includes a pair of oppositely disposed support plates spaced apart a distance slightly greater than the width of the divider panels and on which side flaps foldably connected to the divider panels rest, and ledges on which the end flaps rest.

10. Blank folding apparatus as claimed in claim 9 wherein said support plates have smoothed edges to fold in the side flaps connected to the divider panels as the blank is pushed off said support plates by said first folding means and advanced from said first folding station to said second folding station.

11. Blank folding apparatus as claimed in claim 6 wherein a transfer device is provided to remove the erected carton from said second folding station.

12. Blank folding apparatus as claimed in claim 11 including two gates associated with said transfer device, means locating said gates beneath said second folding station, said gates being movable to an open position to allow passage of the folded carton from the apparatus upon operation of said transfer device.

13. Blank folding apparatus as claimed in claim 11 wherein means are provided beneath said second folding station to maintain the carton in its folded position with the divider panels in back-to-back relationship prior to operation of said transfer device.

14. Blank folding apparatus as claimed in claim 13 wherein said means beneath the second folding station comprise bar-like members engageable with the top edges of the side flaps upstanding from the base panels.

* * * * *